United States Patent [19]

McDermid et al.

[11] Patent Number: 4,579,288

[45] Date of Patent: Apr. 1, 1986

[54] PULVERIZER

[75] Inventors: Blair McDermid, Oldhall; Terence Hanson, Renfrewshire, both of Scotland

[73] Assignee: James Howden & Company Limited, Glasgow, Scotland

[21] Appl. No.: 581,110

[22] Filed: Feb. 21, 1984

[30] Foreign Application Priority Data

Aug. 24, 1983 [GB] United Kingdom ..... 8322754

[51] Int. Cl.[4] ..... B02C 19/06

[52] U.S. Cl. ..... 241/39; 241/41; 241/52; 241/57; 241/80; 241/97

[58] Field of Search ..... 241/5, 39, 40, 41, 48, 241/56, 57, 80, 97

[56] References Cited

U.S. PATENT DOCUMENTS 2,304,264 12/1942 Lykken ..... 241/39

4,219,164 8/1980 Taylor ..... 241/39 X

*Primary Examiner*—Howard N. Goldberg

*Assistant Examiner*—Timothy V. Eley

*Attorney, Agent, or Firm*—Barnes & Thornburg

[57] ABSTRACT

A pulverizer for pulverizing solid material such as coal in which the chmaber of the pulverizer has jets of fluid projected thereinto at high speed to cause the particles to impact against one another to effect the pulverizing and in which a sleeve is mounted within the pulverizer chamber so that the coarser particles which pass upwardly through the sleeve flow downwardly in the annular space between the sleeve and the chamber side wall, to be re-entrained by the nozzles and projected again into the sleeve for further impacting.

8 Claims, 5 Drawing Figures

PULVERIZER

BACKGROUND TO THE INVENTION

The present invention relates to pulverizers. Pulverizers have been suggested, for example, in European Pat. No. 0017367 in which the pulverizer chamber is provided with bottom, top and side walls and the material to be pulverized, such as coal, is introduced thereinto and is taken up by jets of high velocity fluid, such as steam, the jets extending along lines which are between a radius and a tangent to the chamber. In theory the coarser particles descend as a curtain protecting the side walls of the chamber from wear. In practice it has been found that this does not work fully satisfactorily and while a central vortex is formed in the chamber, there is a tendency for the heavier particles not to move downwardly, but rather to move upwardly as a sleeve and for these to exit from the pulverizer with the finer particles. This is clearly unsatisfactory if one wishes to obtain really very fine particles indeed.

SUMMARY OF THE INVENTION

It is now proposed, according to the present invention, to provide a pulverizer comprising a chamber having bottom, upper and side walls, an inlet for material to be pulverized and an upper outlet for the pulverized material, a sleeve mounted with its axis substantially vertical in said chamber, the peripheral wall of the sleeve being spaced from the side walls of the chamber and the upper and lower ends of the sleeve being spaced from the upper and lower walls of the chamber, a plurality of fluid nozzles for projecting fluid jets at high velocity inwardly into the sleeve adjacent the lower end thereof along lines extending between a radius and a tangent to the sleeve, to cause particles of the material to be pulverized to impinge on one another, to effect the pulverizing action, whereby the heavier particles leaving said sleeve move outwardly over the top end of the sleeve, drop downwardly in the space between the chamber side walls and the sleeve and are re-entrained by the fluid jets for further pulverizing action in the sleeve.

It has been found that the provision of the sleeve improves the performance considerably. The geometry of a sleeve mounted so that it is spaced from the chamber wall promotes a strong downflow in the annular gap between the wall and the sleeve giving, in effect, a secondary gas flow entraining the heavier oversize particles downwardly inside the chamber wall. These particles are picked up by the nozzles and are re-entrained and are projected into the inner sleeve again for repulverizing.

In a preferred construction, the chamber has a cylindrical side walls and the sleeve is a cylindrical sleeve coaxial therewith, so that the space therebetween is fully annular and of substantially constant cross-section around the periphery of the sleeve. While it is contemplated that the jets could be introduced below the sleeve, advantageously, the sleeve is provided, at locations spaced from the lower end, with a plurality of openings, one for each nozzle, the nozzles being located outwardly of the openings, thereby to facilitate re-entrainment of the particles.

It has been found that with such a construction, one is able to control the quality of the product leaving the vessel. The value of the ratio of particle size depends primarily on the geometry of the entrainment region on the flow resistance in the annular gap. It has been found that the provision of a short jet pipe in each opening, which surrounds and guides the jet leaving the associated nozzle, further facilitates the entrainment of the particles and gives the ability to control the particle ratio size by choosing jet pipes of the desired dimensions.

The upper outlet to the chamber is preferably positioned directly over the sleeve and its position may be vertically adjusted. This again enables one to control the flow resistance in the annular gap particularly if the outlet is in the form of a vertically adjustable tube having a peripheral annular flange overlying at least a part of the space between the chamber side wall and the sleeve.

Further advantages arise if the sleeve includes a vortex separator adjacent its upper end to separate the finer pulverized material so that it is directed to a position adjacent the axis of the sleeve so that it can flow readily out of the outlet, from the coarser material which is directly outwardly into the space between the chamber side walls and the sleeve for re-entrainment.

The vortex separator may comprise, in the other part of the sleeve, a vertical tube communicating at its lower end with the interior of the sleeve, a central separator body within the lower end of said tube and a plurality of generally radial swirl vanes extending from said tube to said central separator body to impart a vortex swirl to the fluid passing up through said tube. The upper part of the sleeve is conveniently provided with a tapered portion and the upper end of the tube is mounted therewithin to depend from the upper end of said tapered portion.

BRIEF DESCRIPTION OF THE DRAWINGS

In order that the invention may more readily be understood, the following description is given, merely by way of example, reference being made to the accompanying drawings, in which.

DETAILED DESCRIPTION OF SPECIFIC EMBODIMENTS

Figure 1:
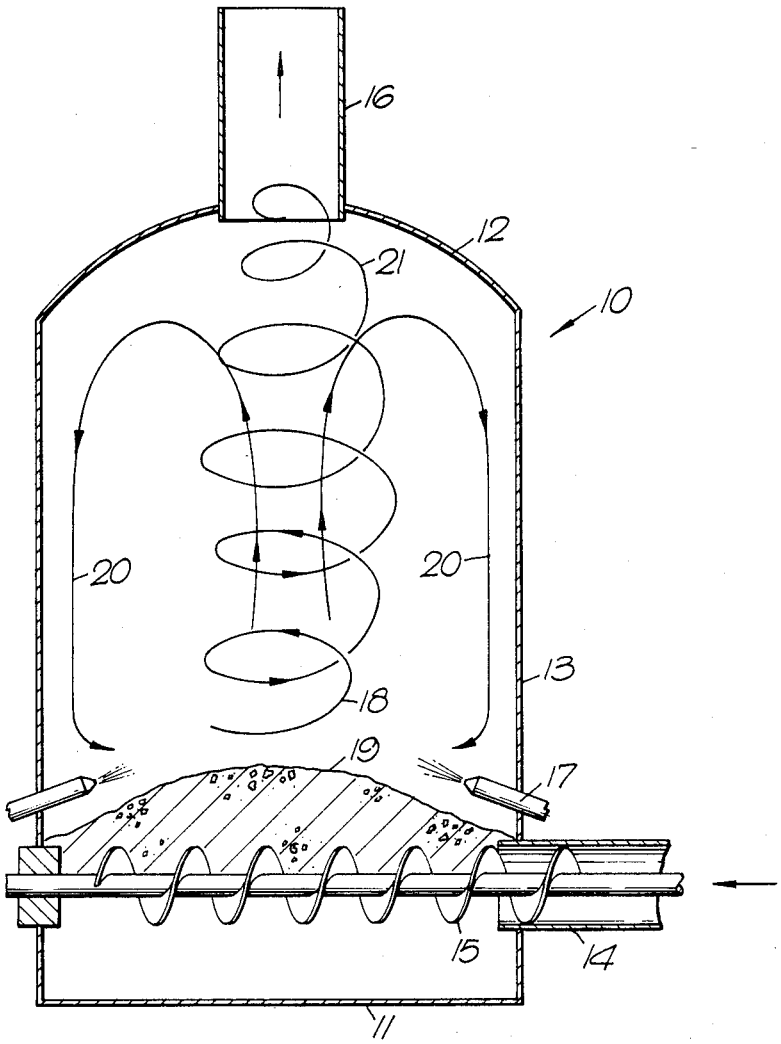
FIG. 1 is a schematic view illustrating the theoretical flow pattern within a processor according to European Pat. No. 0017367.

Referring first to FIG. 1, there is illustrated very schematically, an embodiment of apparatus similar to that disclosed in European Pat. No. 0017367. This apparatus includes a chamber 10 having a bottom wall 11, a domed top wall 12, and a cylindrical side wall 13. Passing through the side wall 13 is an inlet 14 provided with a feed auger 15 while the top wall is provided with a central discharge outlet 16 for the pulverized product. A plurality of nozzles 17 are arranged to project slightly upwardly and, at an angle between a radius and a tangent, so that they thus extend essentially along a chord. The nozzles, produce a central vortex 18 picking up with them the material, such as coal, 19, this material thus being pulverized by interparticle impact. At the same time there is, in theory, a centrifugal or vortex separation effect with the heavier particles flowing upwardly, outwardly and then downwardly along the lines marked at 20 so that they are recycled for further pulverizing. The finer product goes into the centre of the vortex at 21 and exits via the outlet 16.

Figure 2:
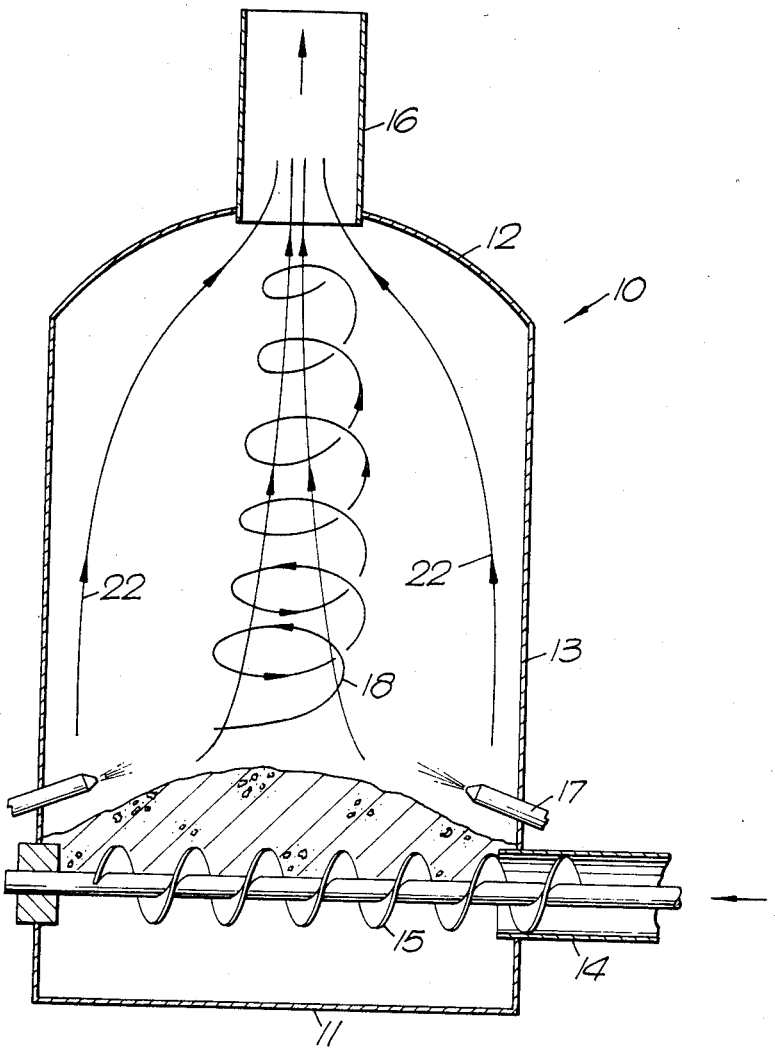
FIG. 2 is a similar view but illustrating what is believed to be the actual flow pattern with the apparatus described in the said European Patent.

Experiments carried out on such an apparatus seem to show that the actual flow pattern is more as shown in FIG. 2, in which like parts have been indicated by like reference numerals and the vortex has again been indicated by the reference numeral 18. However, the flow in the peripheral region in which the coarse particles are thrown out by the vortex or centrifugal separation action is shown at 22 as being a generally upward, rather than a generally downward, flow and some of these coarser particles, instead of being returned to the vicinity of the nozzles for re-entrainment are in fact allowed to escape via the outlet 16 in a state in which they are not pulverized to the required degree.

Referring now to FIG. 3, again like parts 10 to 17 have been indicated by like reference numerals but with the addition of 100 so that the chamber is indicated by the reference numeral 110, the bottom wall by the numeral 111 etc. In the construction according to the invention, however, an inner sleeve 130 is mounted within the chamber 110 and is spaced therefrom to provide an annular space 131. The sleeve 130 has a lower frusto-conical peripheral flange 132 which abuts the chamber wall 113 and a short distance above this flange 132 there is provided a plurality of openings 133 each opening being aligned with one of the nozzles 117. It has been found that such a construction induces the central vortex 118 and at the same time produces a primary upwardly directed flow path 140 of the finer particles which are separated out in this vortex while there is, at the same time, produced a secondary flow path 141 which passes over the top of the sleeve 130 and into the annular space 131. The secondary flow causes the coarser heavier particles to flow over the top of the sleeve and down through the annular space for re-entrainment by the nozzles 117. With this arrangement there is a better separation of the fine particles from the coarse particles and it is only the fine particles in the centre of the vortex 140 which tend to exit through the outlet 116.

Figure 3:
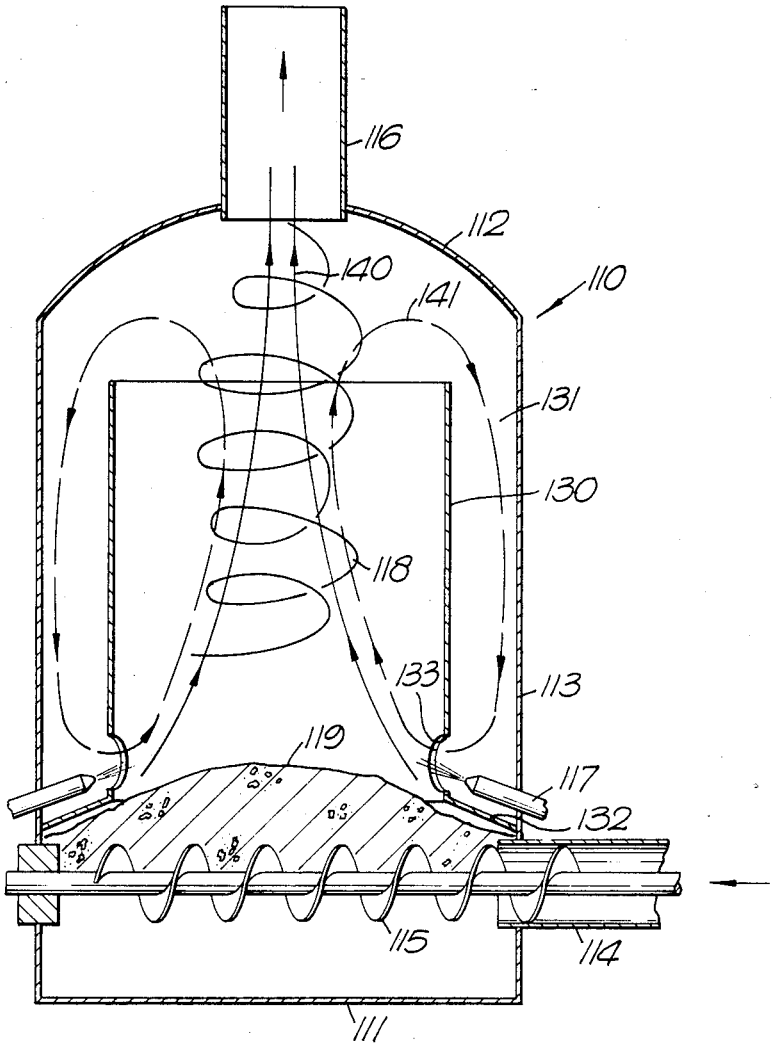
FIG. 3 is a similar schematic view of one embodiment of apparatus according to the invention illustrating the flow pattern therein.
Figure 4:
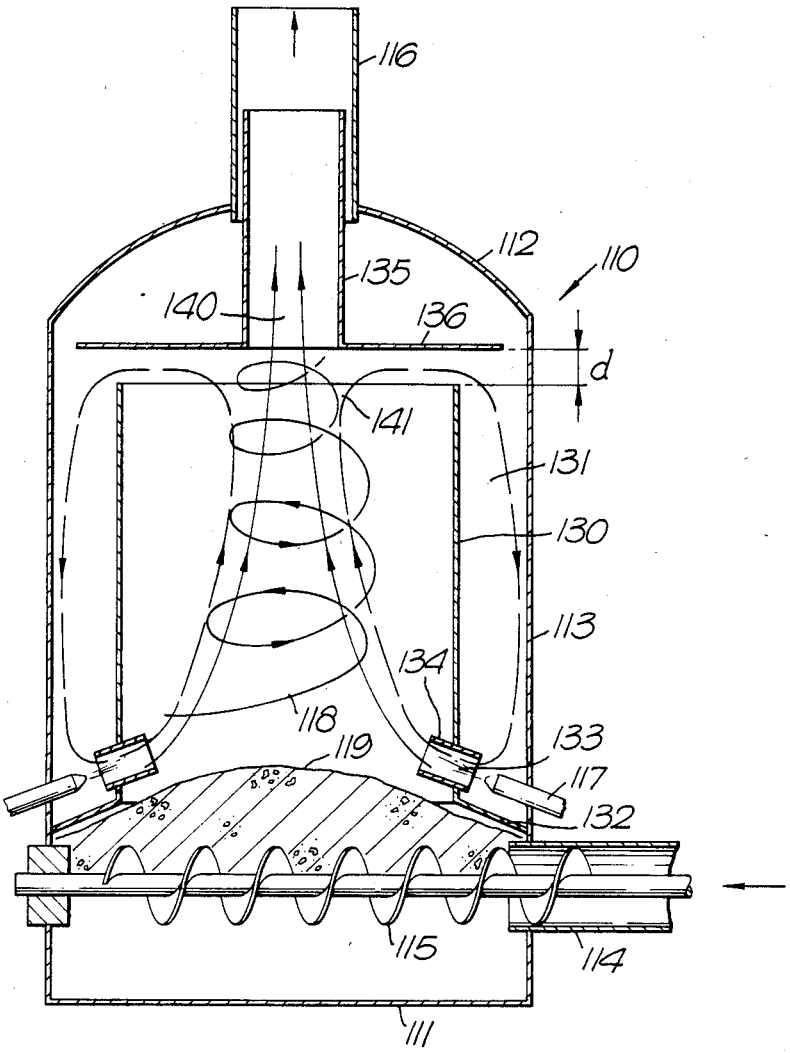
FIG. 4 is a similar view of a modified construction.

FIG. 4 illustrates a further construction which is generally similar to that of FIG. 3 and again like parts have been illustrated by like reference numerals to those of FIG. 3. There are, however, some additional features. The openings 133 are each provided with a short jet pipe 134 which surrounds the jet emanating from each nozzle 117 and it has been found that this further facilitates the entrainment of the coarser solid particles in the flow from each jet. By varying the length and/or diameter of the jet pipes 134 one can control to a certain extent the coarseness of the particles which are allowed to escape via the outlet 116. The second modification is the provision of an adjustable outlet in the form of a vertically adjustable tube 135 having a flange 136 at its lower end which overlies at least the inner part of the annular space 131. By controlling the distance d of the flange 136 from the upper end of the sleeve 130, one again can control the degree of re-entrainment and the degree of pulverization.

Figure 5:
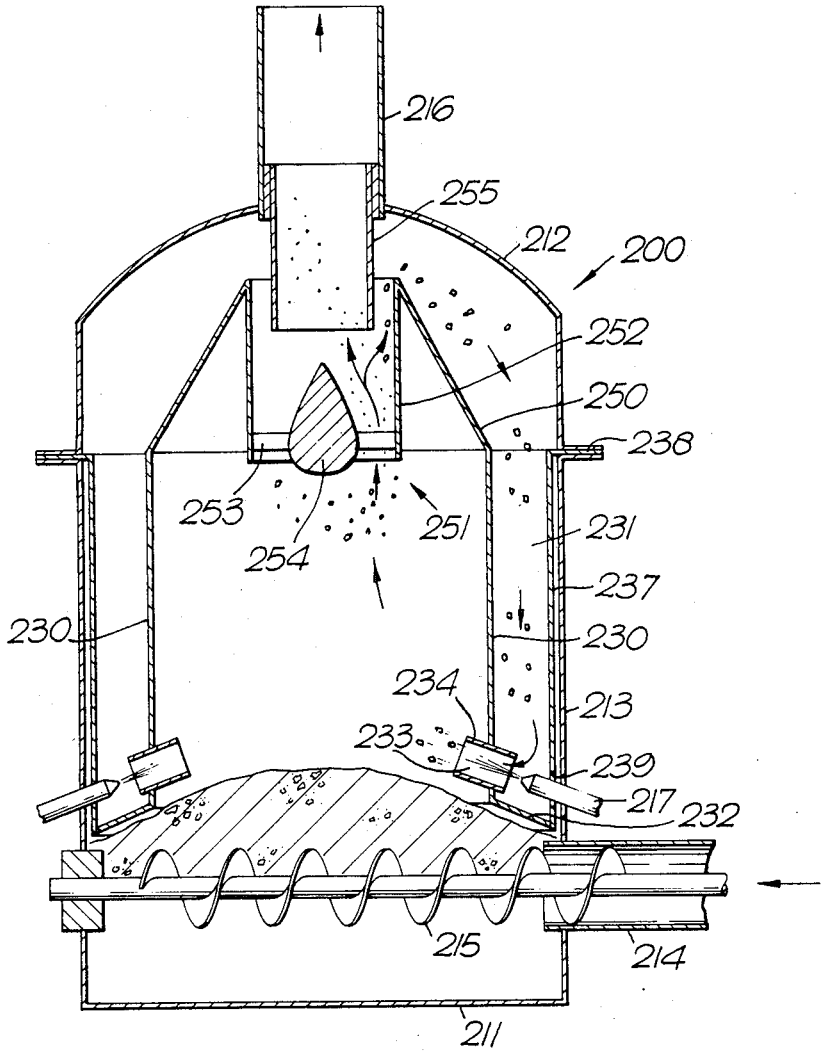
FIG. 5 is a similar view of a further modified construction.

FIG. 5 shows a further modification and again like parts have been shown by like reference numerals except in this instance, they are 200 greater than in FIG. 1 so that the chamber has the general reference numeral 210. This chamber includes, once again a bottom wall 211, a top wall 212, a side wall 213 which is generally cylindrical and an inlet 214 with an auger 215, an outlet 216 being provided in the top wall.

In this construction, however, there is provided a liner 237 having an upper flange 238, by which it is supported, and the liner is connected via the conical flange 232 to the lower end of the sleeve 230. Further openings 239 are provided in the liner, these being aligned with the openings 233 which are provided once again with jet pipes 234.

At its upper end the sleeve 230 is provided with a conically tapered portion 250 from the upper end of which depends a vortex separator indicated by the general reference numeral 251, this including a vertical tube 252 which is coaxial with the sleeve and is provided with a plurality of generally radially extending swirl vanes 253 connected to a central separator body 254. The outlet 216 is provided with a vertical downward extension 255, which can be vertically adjustable and is shown extending into the tube 252.

The operation of this construction is generally similar to that of FIG. 3 and there is a secondary flow in the annular space 231 between the sleeve 230 and the liner 237 and once again there is re-entrainment through the openings 233 and jet pipes 234 under the action of the nozzles 217. The provision of the vortex separator helps to assist in the separation of the fine particles passing up through the extension 255 and thence out of the outlet 216 from the coarser particles into the annular space 231 for re-entrainment.

It will be seen that the internal portions of the apparatus are, in effect, manufactured as a single piece and are supported by the liner which fits closely within the pressure vessel formed by the chamber 210. In this way the parts which are most subject to wear can be removed from the main vessel 210 and replaced when they wear. Furthermore, different configurations of the internal parts can be provided for different uses.

It is contemplated also that the liner 237 can extend significantly further upwardly and indeed can extend beyond the upper end of the conical portion 250 of the inner sleeve.

The various constructions of the present invention have the advantages that they produce a secondary flow for recycling of oversized particles, this secondary flow being driven by entrainment of the primary flow. Other fluid energy mills typically require an auxiliary gas flow and this is not necessary with the construction of the present invention. Furthermore, regulation of the resistance of the secondaray flow path can be used to control the "cut size" of the finished product.

We claim:

1. A pulveriser comprising a chamber, bottom, upper and side walls forming said chamber, an inlet for material to be pulverised and an upper outlet for the pulverised material, a sleeve, an axis of said sleeve, said sleeve being mounted with its axis substantially vertical in said chamber, said sleeve including a peripheral wall having upper and lower ends, the peripheral wall of said sleeve being displaced from the side walls of the chamber to define a space therebetween and the upper and lower ends of the sleeve being spaced from the upper and bottom walls of the chamber, a plurality of openings in said sleeve adjacent the lower end thereof, a plurality of fluid nozzles located outwardly of the openings for projecting fluid jets at high velocity inwardly directly through said openings into the interior of the sleeve adjacent the lower end thereof along lines extending between a radius and a tangent to the sleeve, to cause particles of the material to be pulverised to impinge on one another, to effect the pulverising action, and a flange sealingly joining a lower part of the sleeve below said openings to the peripheral wall of the chamber, whereby the heavier particles leaving said sleeve move outwardly over the top end of the sleeve, drop downwardly in the space between the chamber side walls and the sleeve and are reentrained by the fluid jets for further pulverising action in the sleeve.

2. A pulverizer as claimed in claim 1, wherein the chamber has cylindrical side walls and the sleeve is a cylindrical sleeve coaxial therewith, to provide an annular space therebetween.

3. A pulverizer as claimed in claim 1, and further comprising a jet pipe for each opening, which surrounds and guides the jet leaving the associated nozzle to further facilitate the entrainment of the particles.

4. A pulverizer as claimed in claim 1, wherein the upper outlet is positioned directly over the sleeve and its position is vertically adjustable.

5. A pulverizer as claimed in claim 4, wherein the outlet is in the form of a vertically adjustable tube having a peripheral annular flange overlying at least the inner part of the space between the chamber side wall and the sleeve.

6. A pulverizer as claimed in claim 1, and further comprising a vortex separator adjacent the upper end of said sleeve effective to separate the finer pulverized material so that it is directed to a position adjacent the axis of the sleeve from the coarser material which is directed outwardly into said space between the chamber side wall and the sleeve.

7. A pulverizer as claimed in claim 6, wherein the vortex separator comprises, in the upper part of the sleeve, a vertical tube communicating, at its lower end, with the interior of the sleeve, a central separator body within the lower end of said tube and a plurality of generally radial swirl vanes extending from said tube to said central separator body, to impart a vortex swirl to the flow passing up through said tube.

8. A pulverizer as claimed in claim 7, wherein the upper part of said sleeve further comprising a tapered portion and wherein the upper end of said tube is mounted therewithin, to depend from the upper end of said tapered portion.

* * * * *